US011910888B1

(12) United States Patent
Hopkins et al.

(10) Patent No.: US 11,910,888 B1
(45) Date of Patent: Feb. 27, 2024

(54) MOUNTS FOR TRACKING DEVICES

(71) Applicant: Elevation Lab, Inc., Portland, OR (US)

(72) Inventors: Casey Hopkins, Portland, OR (US); Jacob Hull, Portland, OR (US); Mitchell T. Wilson, Portland, OR (US)

(73) Assignee: Elevation Lab, Inc., Portland, OR (US)

( * ) Notice: Subject to any disclaimer, the term of this patent is extended or adjusted under 35 U.S.C. 154(b) by 0 days.

(21) Appl. No.: 18/345,128

(22) Filed: Jun. 30, 2023

(51) Int. Cl.
*A44C 3/00* (2006.01)
*A44B 9/16* (2006.01)
*A44B 9/18* (2006.01)

(52) U.S. Cl.
CPC . *A44B 9/16* (2013.01); *A44B 9/18* (2013.01)

(58) Field of Classification Search
CPC . A44C 3/001; Y10T 24/3649; Y10T 24/1365; A44B 9/16; A44B 9/18
See application file for complete search history.

(56) References Cited

U.S. PATENT DOCUMENTS 675,213 A * 5/1901 Harris ..... A44C 3/001 24/103
714,538 A * 11/1902 Walter ..... B43K 23/001 24/13
1,785,186 A * 12/1930 Day ..... A44C 3/001 40/765
2,013,485 A * 9/1935 Woldemar ..... B44C 5/04 24/351
2,491,166 A * 12/1949 Di Stiso ..... A44C 1/00 220/DIG. 26
2,515,551 A * 7/1950 Cohen ..... A45D 8/185 223/109 R
3,312,255 A 4/1967 Ellison
3,608,685 A 9/1971 Childress
(Continued)

FOREIGN PATENT DOCUMENTS

CN 306512384 S 11/2020
CN 306806113 S 5/2021
(Continued)

OTHER PUBLICATIONS

New IPX8 Waterproof AirTag Holder/Case, Amazon, date first available Nov. 16, 2022, (online) URL: https://www.amazon.com/Waterproof-Adhesive-Sticker-Compati ble-Luggage/dp/B0 BM L9S KPX (Year: 2022).

(Continued)

*Primary Examiner* — Robert Sandy
*Assistant Examiner* — Michael S Lee
(74) *Attorney, Agent, or Firm* — Kolitch Romano Dascenzo Gates LLC

(57) ABSTRACT

Mounts (10) for securing devices (12) to articles (14) comprise a housing (16) and a pin (18) coupled to the housing (16). The housing (16) has a first side (50), a second side (52) opposite the first side (50), and a central axis (54), and the housing (16) is configured to receive the device (12). The pin (18) comprises a piercing end (20) and has an open position (22) and a closed position (24). In the open position (22), the pin (18) extends away from the second side (52) of the housing (16), and the piercing end (20) is spaced away from the housing (16) and is positioned to pierce the article (14). In the closed position (24), the piercing end (20) is closer to the housing (16) than when in the open position (22).

20 Claims, 11 Drawing Sheets

(56) References Cited

U.S. PATENT DOCUMENTS 3,953,722 A * 4/1976 Stick ..... F21V 21/088 24/13
4,531,310 A * 7/1985 Acson ..... A44C 3/001 40/1.5
4,597,206 A * 7/1986 Benson ..... A44C 3/001 24/103
D375,695 S 11/1996 Narai
5,585,867 A 12/1996 Ooya
5,748,087 A 5/1998 Ingargiola et al.
D402,805 S 12/1998 Nagano et al.
5,878,698 A 3/1999 Lyell
D407,985 S 4/1999 Pimentel
D409,086 S 5/1999 Brown et al.
D414,186 S 9/1999 Hogenbirk
D415,480 S 10/1999 Kendall et al.
D440,397 S 4/2001 Bardet
6,243,870 B1 6/2001 Graber
D447,067 S 8/2001 Vollenweider
D511,699 S 11/2005 Pan
6,970,090 B1 11/2005 Sciarra
D556,938 S 12/2007 Russello et al.
D571,557 S 6/2008 Lawler
D575,649 S 8/2008 Scalisi et al.
D598,018 S 9/2009 Sumi
7,598,869 B2 10/2009 Kumagai et al.
D609,123 S 2/2010 Pace
7,780,972 B2 8/2010 Hurwitz
D632,853 S 2/2011 Hardi et al.
D633,644 S 3/2011 Sprengers
D647,227 S 10/2011 Kaule et al.
8,148,701 B2 4/2012 Yoder
D661,846 S 6/2012 Miller et al.
8,195,313 B1 6/2012 Fadell et al.
D666,367 S 8/2012 Miller et al.
D683,251 S 5/2013 Dumas et al.
D703,394 S 4/2014 Bozeman
D713,103 S 9/2014 Sproviero et al.
D726,161 S 4/2015 Howard et al.
D729,773 S 5/2015 Salojarvi et al.
D735,131 S 7/2015 Akana et al.
D750,980 S 3/2016 Takach et al.
D752,588 S 3/2016 Li
D757,585 S 5/2016 HøJmose
D757,587 S 5/2016 Li
9,526,433 B2 12/2016 Lapetina et al.
D779,977 S 2/2017 Jacob et al.
D781,572 S 3/2017 Duval
D783,422 S 4/2017 Kashimoto
D790,514 S 6/2017 Woodward et al.
D795,109 S 8/2017 Olodort et al.
D803,410 S 11/2017 Im et al.
D804,533 S 12/2017 Mangum et al.
D812,577 S 3/2018 Turksu et al.
D817,332 S 5/2018 Yaprak et al.
D817,558 S 5/2018 Lee et al.
D817,793 S 5/2018 Vu et al.
D818,854 S 5/2018 Kachar et al.
D820,238 S 6/2018 Boshernitzan et al.
D820,318 S 6/2018 Mullins et al.
9,996,996 B2 6/2018 Siebels et al.
D822,921 S 7/2018 Wen
D822,922 S 7/2018 Wen
D825,549 S 8/2018 Lebovitz
D826,748 S 8/2018 Kim et al.
10,176,691 B2 1/2019 Smoak
D843,238 S 3/2019 Rose et al.
10,271,524 B2 4/2019 Chen
10,305,178 B2 5/2019 Gibson et al.
D852,150 S 6/2019 Turksu et al.
D854,950 S 7/2019 Seum et al.
D858,904 S 9/2019 Zinn et al.
D865,859 S 11/2019 Ben Avi
D867,909 S 11/2019 Kachar
D870,399 S 12/2019 Van Curen et al.
D883,581 S 5/2020 Daly et al.
D890,002 S 7/2020 Cound et al.
D890,754 S 7/2020 Raken et al.
D895,465 S 9/2020 Loew et al.
D896,798 S 9/2020 Yang
D898,613 S 10/2020 Stapleton
D900,812 S 11/2020 Friedman et al.
D911,191 S 2/2021 Qi
D920,138 S 5/2021 Kuwashiro et al.
D926,396 S 7/2021 Jia
D929,051 S 8/2021 Li
11,160,335 B2 11/2021 Eidelman et al.
D938,668 S 12/2021 Jia
D939,972 S 1/2022 Erbacher et al.
11,224,301 B2 1/2022 DeLgado
D943,438 S 2/2022 Chen
D943,845 S 2/2022 Li
11,308,744 B1 4/2022 Exantus
D952,961 S 5/2022 Li
D956,765 S 7/2022 Lee et al.
11,393,319 B1 7/2022 Maisano, II et al.
D960,013 S 8/2022 Konen et al.
D960,129 S 8/2022 Karimi et al.
D960,562 S 8/2022 Lee et al.
D964,667 S 9/2022 Mo
D970,372 S 11/2022 Aneja
D977,278 S 2/2023 Ramm et al.
D983,066 S 4/2023 Wright et al.
D983,786 S 4/2023 Herrmann
2002/0197960 A1 12/2002 Lee et al.
2006/0061546 A1 3/2006 Jong
2007/0034165 A1 2/2007 Yang
2007/0253192 A1 11/2007 Monteiro et al.
2008/0165056 A1 7/2008 Bader
2008/0198585 A1 8/2008 Tait
2009/0322480 A1 12/2009 Benedict et al.
2010/0147854 A1 6/2010 Fauveau
2010/0238033 A1 9/2010 Blumel et al.
2012/0033898 A1 2/2012 Barron
2012/0118980 A1 5/2012 Yoder
2012/0147594 A1 6/2012 Tait
2013/0208938 A1 8/2013 Midha
2014/0002239 A1 1/2014 Rayner
2014/0180019 A1 6/2014 Martinez et al.
2014/0331942 A1 11/2014 Sarazyn
2015/0150319 A1 6/2015 Walmsley
2015/0297134 A1 10/2015 Albert et al.
2015/0356861 A1 12/2015 Daoura et al.
2015/0356862 A1 12/2015 Daoura et al.
2015/0359127 A1 12/2015 Daoura et al.
2016/0058149 A1 3/2016 Dhanasekaran
2016/0071392 A1 3/2016 Hankey et al.
2016/0247156 A1 8/2016 Hwang et al.
2016/0247379 A1 8/2016 Forbes
2016/0266606 A1 9/2016 Ricci
2016/0291162 A1 10/2016 Larkins
2017/0079336 A1 3/2017 Hirschberg et al.
2017/0135315 A1 5/2017 Marmen et al.
2017/0135414 A1 5/2017 Fultz
2017/0302099 A1 10/2017 Bolden et al.
2017/0360169 A1 12/2017 Stein
2018/0299991 A1 10/2018 Juhasz et al.
2018/0325426 A1 11/2018 Shaw et al.
2019/0103012 A1 4/2019 Daoura et al.
2020/0107522 A1 4/2020 Kersey et al.
2020/0169848 A1 5/2020 Daoura et al.
2020/0337162 A1 10/2020 Perkins et al.
2020/0352300 A1 11/2020 Sube
2021/0020020 A1 1/2021 Rothschild et al.
2021/0274315 A1 9/2021 Daoura et al.
2021/0274754 A1 9/2021 Talley et al.
2021/0306807 A1 9/2021 Kashani-Nejad et al.
2021/0307294 A1 10/2021 Kimbel
2022/0051182 A1 2/2022 Fox et al.
2022/0140431 A1 5/2022 Moon

(56) References Cited

U.S. PATENT DOCUMENTS

| | | | |
|---|---|---|---|
| 2022/0265214 | A1 | 8/2022 | Jariwala et al. |
| 2023/0109754 | A1 | 4/2023 | Newton |

FOREIGN PATENT DOCUMENTS

| | | | |
|---|---|---|---|
| CN | 306806204 | S | 6/2021 |
| CN | 306820796 | S | 6/2021 |
| CN | 307127923 | S | 9/2021 |
| CN | 307552161 | S | 4/2022 |
| DE | 3929468 | C1 | 3/1991 |
| EM | 008844344-0001 | S | 3/2022 |
| EM | 008869267-0006 | S | 3/2022 |
| GB | 6189757 | S | 2/2022 |
| GB | 6194869 | S | 3/2022 |
| GB | 6194870 | S | 3/2022 |
| JP | H0544379 | U | 6/1993 |
| WO | WO201311789 | A1 | 8/2013 |
| WO | 2022251483 | A1 | 12/2022 |

OTHER PUBLICATIONS

[Upgrade] I PX8 Waterproof Airtag Sticker Mount, date first available Jan. 12, 2023, (online) URL: https://www.amazon.ca/Upgrade-Waterproof-Adhesive-Protective-Shockproof/dp/B0BRMGPWVK?th=1 (Year: 2023).

Catalyst Lifestyle Limited, "Stick-It" Product Page, https://catalystlifestyle.com/products/total-protection-airtag-stick-it-case?variant=39616587038829, (Apr. 24, 2023).

EBay, "2-Pack Waterproof Airtag Sticker Mount Case for Apple Hidden Air Tag Adhesive," https://ebay.com/itm/195579903589, (Apr. 24, 2023).

Machine-generated English language translation of abstract for DE3929468C1, dated Mar. 7, 1991.

Machine-generated English language translation of abstract for JPH0544379U, dated Jun. 15, 1993.

* cited by examiner

MOUNTS FOR TRACKING DEVICES

FIELD

The present disclosure relates to mounts for tracking devices.

BACKGROUND

In recent years, wireless tracking devices have become popular amongst consumers. Typically, wireless tracking devices are small and require additional hardware to be physically mounted or coupled to an object that a user desires to track. Consumers often use wireless tracking devices for keys, sports equipment, pets, electronic equipment, etc. However, consumers also may wish to keep track of children in situations that may lead to a child becoming lost (e.g., amusement parks). Children often are not good at keeping items in their pockets or cannot otherwise be relied upon to maintain possession of small objects like tracking devices. Also, children often wear clothing without pockets or clothing with pockets whose contents are easily lost.

SUMMARY

Mounts for securing devices to articles comprise a housing and a pin coupled to the housing. The housing has a first side, a second side opposite the first side, and a central axis, and the housing is configured to receive the device. The pin comprises a piercing end and has an open position and a closed position. In the open position, the pin extends away from the second side of the housing, and the piercing end is spaced away from the housing and is positioned to pierce the article. In the closed position, the piercing end is closer to the housing than when in the open position.

DESCRIPTION

Figure 1:
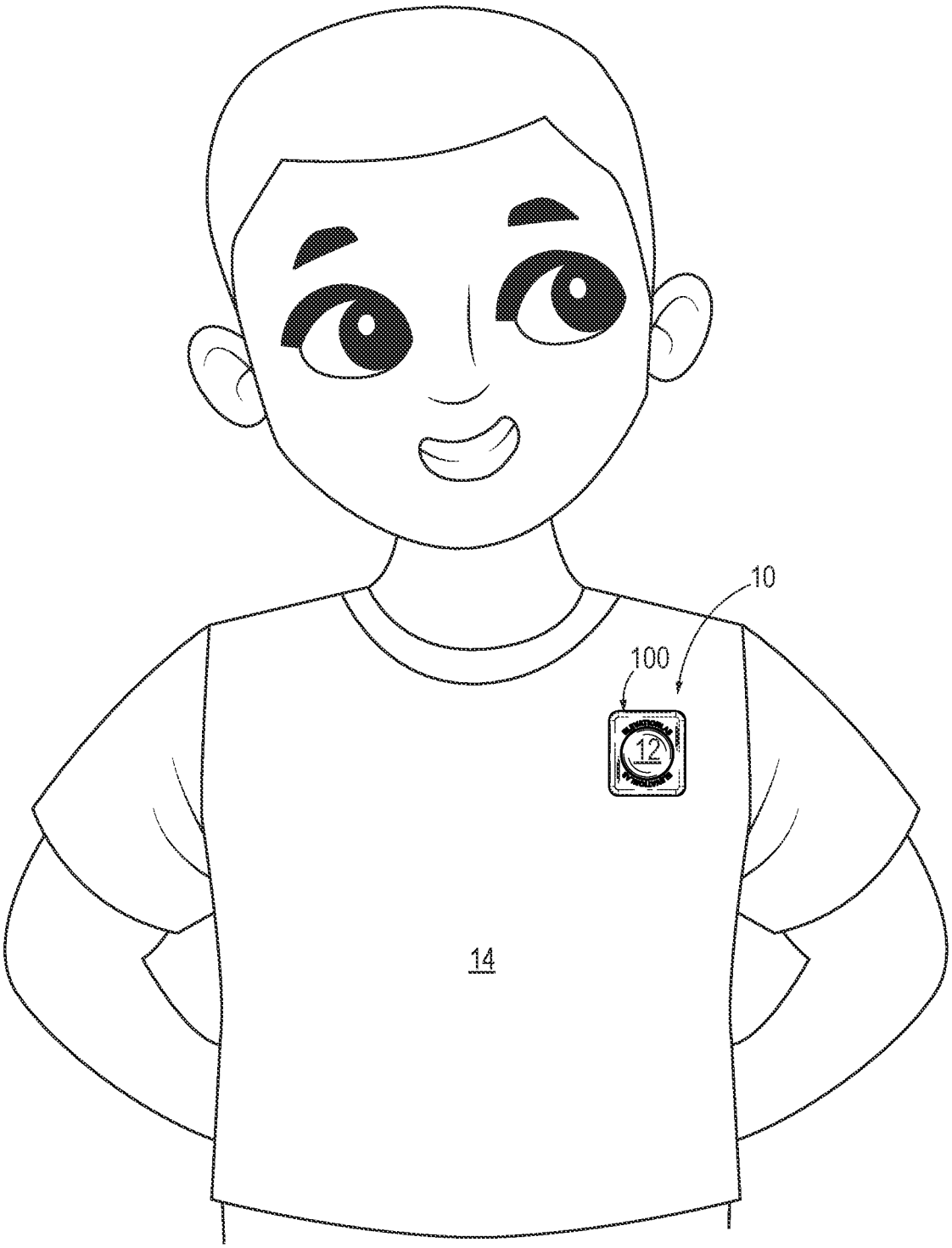
FIG. 1 is an illustration of a child with an example mount according to the present disclosure attached to the child's shirt.

Mounts 10 for securing devices 12 to articles 14 are disclosed herein. Examples of devices 12 include wireless (e.g., WiFi, Bluetooth™, GPS) tracking devices (e.g., Apple AirTag™, Tile™, Samsung Galaxy SmartTag™, Chipolo One™, CubePro™, Orbit™, and Baseus™ branded tracking devices); and examples of articles 14 include apparel, bags, backpacks, purses, blankets, and any other articles capable of being pierced by a pin 18 of a mount 10, such as an article constructed from a fabric or other flexible material. Functionally, mounts 10 may be used to secure a tracking device to an object that a user desires to keep track of. For example, in FIG. 1, a non-exclusive example of a mount 10 is illustrated pinned to a shirt of a child. In this example, mounts 10 may be used to track the location of a lost child, such as at amusement parks or elsewhere.

Figure 2:
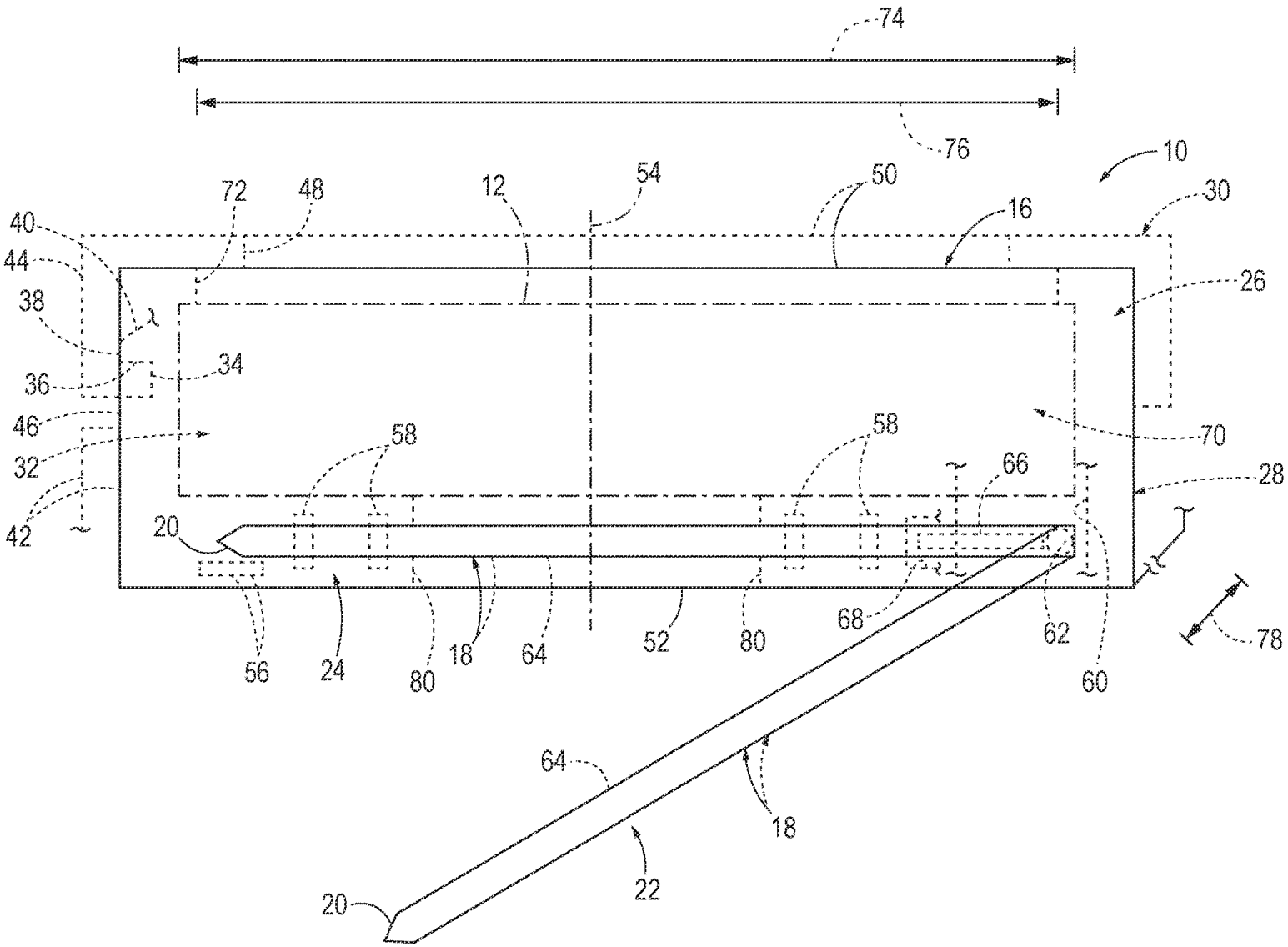
FIG. 2 is a schematic illustration representing mounts for tracking devices according to the present disclosure.

FIG. 2 schematically illustrates mounts 10 according to the present disclosure. Generally, in FIG. 2, elements that are likely to be included in a given example are illustrated in solid lines, while elements that are optional to a given example or correspond to a specific example are illustrated in broken lines. However, elements that are illustrated in solid lines are not essential to all examples of the present disclosure, and an element shown in solid lines may be omitted from a particular example without departing from the scope of the present disclosure.

As schematically illustrated in FIG. 2, mounts 10 comprise a housing 16 and at least one pin 18 that is coupled to the housing 16. The housing has a first side 50, a second side 52 opposite the first side 50, and a central axis 54 that extends through the first side 50 and the second side 52. The housing 16 is configured to receive a device 12. Accordingly, when a device 12 is received within the housing 16, the mount 10 may be operatively attached (i.e., pinned) to an article 14, such as an article of apparel.

Some examples of mounts 10 comprise a plurality of pins 18, and in some such examples, exactly two pins are present. In some examples, the housing 16 comprises a body 28, which may be described as having a body width 78 and a body perimeter 42, and each pin 18 of the plurality of pins 18 is positioned within 15% of the body width 78 from the body perimeter 42. Accordingly, in such an example, the pins 18 are position adjacent to a perimeter, or edge, of the mount 10 and provide a stable attachment to an article 14. That is, such a configuration serves to reduce flopping of a mount 10 on an article, which may be beneficial when a user is running, jumping, playing, etc.

Each pin 18 comprises a piercing end 20 and may be described as having an open position 22 (or open configuration 22) and a closed position 24 (or closed configuration 24). In the open position 22, the pin 18 extends away from the second side 52 of the housing 16, and the piercing end 20 is spaced away from the housing 16 and is positioned to pierce the article 14. In the closed position 24, the piercing end 20 is closer to the housing 16 than when in the open position 22. Accordingly, in use, a user configures the pin(s) 18 to the open position 22, pierces the article 14 with the piercing end(s) 20 (e.g., first in one direction and then in an opposite direction through the article 14), and then configures the pin(s) 18 to the closed position 24 to operatively couple the mount 10 to the article 14. In some examples, the housing 16 comprises a catch 56 associated with each pin 18, and the catch 56 is configured to selectively retain a respective pin 18 in its closed position 24. In some examples, the pin(s) 18 are biased toward the open position 22, and a user must urge a pin 18 against its bias to reposition the pin 18 from the open position 22 to the closed position 24. In some examples, the pin 18 comprises a torsion spring 62 that biases the pin 18 toward the open position 22.

The housing 16 of a mount 10 may be described as having or defining an envelope 26 that corresponds to a smallest rectangular prism that encompasses the housing 16. In some examples of mounts 10, the piercing end(s) 20 of the pin(s) 18 are positioned within the envelope 26 when the pin(s) 18 are in the closed position 24. In some such examples, an entirety of the pin(s) 18 is positioned within the envelope 26 when in the closed position 24. As a result, such mounts 10 have a low profile, and when operatively coupled to an article 14, the center of gravity of a mount 10 will be positioned closer to the article 14 than if the pin(s) 18 were not fully encompassed within the envelope 26. Accordingly, such mounts 10 are less prone to flop around or otherwise deform the article 14 under the weight of the mount 10 and the device 12.

With continued reference to FIG. 2, in some examples of mounts 10, the housing 16 comprises a body 28 and a cover 30, with the body 28 and the cover 30 collectively defining a volume 32 configured to receive a device 12. Accordingly, when included in a mount 10, the cover 30 serves to retain a device 12 within the volume 32 and, in some examples, to restrict the device 12 from being inadvertently removed from the mount 10. In some examples, the cover 30 is removably coupled to the body 28. For example, the cover 30 may have a snap-fit with the body 28. In some such examples, the cover 30 is flexible (e.g., constructed of rubber, silicone, or other flexible and resilient material) and has a stretch-fit with the body 28. In some such examples, the body 28 is more rigid than the cover 30 and thereby provides a foundation to which the cover 30 may be stretch-fit to and removed from.

As schematically illustrated in FIG. 2, in some examples, the cover 30 comprises a lip 34 that extends toward the central axis 54, and the body 28 comprises a ledge 36 that is configured to mate with the lip 34 to operatively retain the cover 30 on the body 28. That is, in such examples, engagement between the lip 34 and the ledge 36 serves to retain the cover 30 on the body 28 until such time that a user selectively removes the cover 30, such as by stretching the cover 30 relative to the body 28 or otherwise engaging and translating the cover 30 relative to the body 28.

In some such examples and as schematically represented in FIG. 2, the body 28 comprises one or more ledge ribs 38 that extend away from the central axis 54 and that define or comprise the ledge 36. That is, the ledge 36 may be defined by one ledge rib 38 or a plurality of ledge ribs 38, including ledge ribs 38 that are spaced apart from one another. In other words, when a plurality of ledge ribs 38 are provided, the ledge 36 does not extend fully around the body 28. Such a configuration may facilitate removal of the cover 30 from the body 28 by reducing the overall friction between the lip 34 and the ledge 36 that would otherwise be present if the ledge 36 did extend fully around the perimeter of the body 28. As schematically represented in FIG. 2, in some examples, the ledge rib(s) 38 comprise a ramped surface 40 opposite the ledge 36. When present, the ramped surface 40 facilitates a user attaching the cover 30 to the body 28, because when a user urges the cover 30 toward the body 28 along the central axis 54, the cover 30 will stretch as it is urged across the ramped surface 40, and/or the ledge rib(s) 38 will deform to permit the cover 30 to pass over the ramped surface 40.

In some examples of mounts 10, the cover 30 is hinged to the body 28. In other examples, the cover 30 is threadingly coupled to body 28.

With continued reference to FIG. 2, the body 28 may be described as having a body perimeter 42, and the cover 30 may be described as having a cover perimeter 44. In some examples of mounts 10 and as schematically represented in FIG. 2, the body 28 defines a recess 46, and the body perimeter 42 and the cover perimeter 44 are coextensive, other than at the recess 46. Accordingly, when present, the recess 46 provides a space for a user to position the user's finger or another object to engage the cover 30 and urge the cover 30 away from the body 28 for removal therefrom.

As schematically represented in FIG. 2, in some examples of mount 10, the cover 30 defines a window 48, through which the device 12 is visible when it is operatively received within the housing 16. Accordingly, a user can easily determine whether or not a device 12 is present without first removing the cover 30. The window may be an opening, a passage, or other void, or the window 48 may be a transparent portion of the cover 30, permitting a user to visually determine if a device 12 is present or not within the housing 16. In some examples in which the window is an opening, the window 48 is sized to restrict passage of the device 12 through the window 48 when the device 12 is operatively received within the housing 16. That is, the window 48 is too small for the device 12 to be removed through the window 48, yet large enough for a user to easily and visually determined the presence of a device 12 within the housing 16.

With continued reference to FIG. 2, in some examples of mounts 10, the housing 16 comprises a plurality of pin ribs 58 that extend toward the pin(s) 18 when the pin(s) 18 are in the closed position 24. In some such examples, each pin rib 58 may be described as extending in close proximity to a respective pin 18 when the pin 18 is in the closed position 24. Accordingly, when the mount 10 is operatively coupled to an article 14, depending on the thickness of the article 14, the pin ribs 58 will serve to pinch, or sandwich, the article 14 between the pin ribs 58 and a pin 18. As a result, the mount 10 will not readily slide back-and-forth on the article 14 along the pin(s) 18. In other words, the pin ribs 58 create friction between the housing 16 and the article 14 due to the article 14 being pinched between a pin 18 and one or more pin ribs 58, whereas, a relationship between the pin(s) 18, such as made from a smooth metal, and the article, such as made from a textile or other fabric, may be very slippery. In some such examples, such a configured mount 10 will be less prone to flop and/or slide around on an article 14 as a result of a user (e.g., a child) running, jumping, playing, etc.

In some such examples, each pin rib 58 extends within 1 millimeter (mm), within 0.5 mm, within 0.3 mm, or even within 0.1 mm of a respective pin 18 when the pin 18 is in the closed position 24. In some examples, one or more pin ribs 58 may extend within a different distance from a respective pin 18 than one or more other pin ribs 58. For example, adjacent pin ribs 58 may extend at different distances, resulting in the corresponding article 14 (e.g., fabric) forming a wave-like shape along a respective pin 18 when the mount 10 is operatively attached to the article 14.

As schematically represented in FIG. 2, in some examples, each pin rib 58 extends transverse to a respective pin 18 when the respective pin 18 is in the closed position. In some examples, each pin rib 58 extends parallel to the central axis 54.

With continued reference to FIG. 2, in some examples of mounts 10, the body 28 of the housing 16 defines a pin-installation cavity 60 that is open toward the first side 50 of the housing 16 and that is configured to receive the pin 18 via the first side 50 of the housing 16. Accordingly, during assembly of such a mount 10, the pin is inserted into and/or through the pin-installation cavity 60 via the first side of the housing 16. In some examples of mounts 10 whose pin(s) 18 comprise a torsion spring 62, the torsion spring 62 is positioned within the pin-installation cavity 60 when the mount 10 is operatively assembled. In some examples, the housing 16 comprises a torsion-spring protrusion 63 that extends into the pin-installation cavity 60 and within the open space of the torsion spring 62 to retain the torsion spring 62, and thus the respective pin 18, within the pin-installation cavity 60. In some examples, the torsion spring 62 and torsion-spring protrusion 63 may be described as forming a snap-fit relationship. In some examples, the torsion-spring protrusion 63 is ramped and/or barbed to facilitate insertion of the torsion spring 62 within the pin-installation cavity 60, as well as to retain the torsion spring 62 within the pin-installation cavity 60 and restrict the torsion spring 62 from being removed from the pin-installation cavity 60.

As schematically indicated in FIG. 2, in some examples, the pin 18 comprises a piercing-end portion 64 that extends from the torsion spring 62, and a grounded portion 66 that extends from the torsion spring 62. In some such examples, the housing 16 defines a grounding slot 68, the grounded portion 66 of the pin 18 extends into the grounding slot 68, and the grounding slot 68 retains the pin 18 with the housing 16. In some such examples, the pin-installation cavity 60 is open to the grounding slot 68. Accordingly, during assembly of such a mount 10, a pin 18 is inserted into the pin-installation cavity 60 via the first side 50 of the housing 16, and the grounded portion 66 is inserted into the grounding slot 68 to secure pin 18 in place.

In some examples of mounts 10, the housing 16 is configured to receive a device 12 in a snap-fit arrangement or a friction-fit arrangement. For example, as schematically represented in FIG. 2, in some examples, the volume 32 of the housing 16 that receives the device 12 may be described as comprising a body portion 70 that is defined by the body 28 (i.e., not directly defined by the cover 30, if present), and the body portion 70 has a maximum body-portion dimension 74 defined by the body 28. The body 28 comprises a terminal lip 72 that defines an inside-lip dimension 76 that is less than the maximum body-portion dimension 74. Accordingly, to position a device 12 in the volume 32 of the housing 16, a user urges the device 12 past the terminal lip 72 to snap the device 12 into place at least partially beyond the terminal lip 72, which then retains the device 12 in place. Accordingly, the body 28 of the housing 16 in such examples must be constructed of a material that permits for deformation of the body 28 under pressure applied by a user and that is resilient to snap-back toward a default configuration.

With continued reference to FIG. 2, in some examples of mounts 10, the housing 16 defines an opening 80 on the second side 52 of the housing 16 that is sized to restrict passage of the device 12 through the opening 80. In such examples, the opening 80, however, is sized large enough to permit a user's finger or other similarly sized tool to extend through the opening 80 via the second side 52 of the housing 16 to engage the device 12 and urge the device 12 along the central axis 54 and out of the housing 16. That is, in examples where the housing 16 and the device 12 define a friction-fit or snap-fit arrangement, the opening 80 permits a user to engage the device 12 and thus, urge the device 12 out of the friction-fit or snap-fit arrangement.

Turning now to FIGS. 3-13, an illustrative non-exclusive example of a mount 10 in the form of mount 100 is illustrated. Where appropriate, the reference numerals from the schematic illustration of FIG. 2 are used to designate corresponding parts of mount 100; however, the example of FIGS. 3-13 are non-exclusive and do not limit mounts 10 to the illustrated embodiment of mount 100. That is, mounts 10 are not limited to the specific embodiment of the illustrated mount 100, and mounts 10 may incorporate any number of the various aspects, configurations, characteristics, properties, etc. of mounts 10 that are illustrated in and discussed with reference to the schematic representations of FIG. 2 and/or the embodiment of FIGS. 3-13, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to mount 100; however, it is within the scope of the present disclosure that the previously discussed features, variants, etc. may be utilized with mount 100.

As seen with reference to FIGS. 3-13, mount 100 may be described as generally square or rectangular in shape with rounded corners and specifically configured to receive a device 12 in the form of an Apple AirTag™. Mount 100 is an example of a mount 10 whose housing 16 comprises a body 28 and a cover 30 removably attached to the body 28. In particular, the cover 30 of mount 100 has a stretch-fit with the body 28. As best seen in the cross-sectional views of FIGS. 9 and 10 and with reference also to FIG. 3, the body 28 of mount 100 comprises four ledge ribs 38 spaced-around the body 28, each with a ramped surface opposite the ledge 36 of the ledge ribs 38. That is, mount 100 is an example of a mount 10 whose ledge 36 does not extend fully around the perimeter of the body 28.

Figure 3:
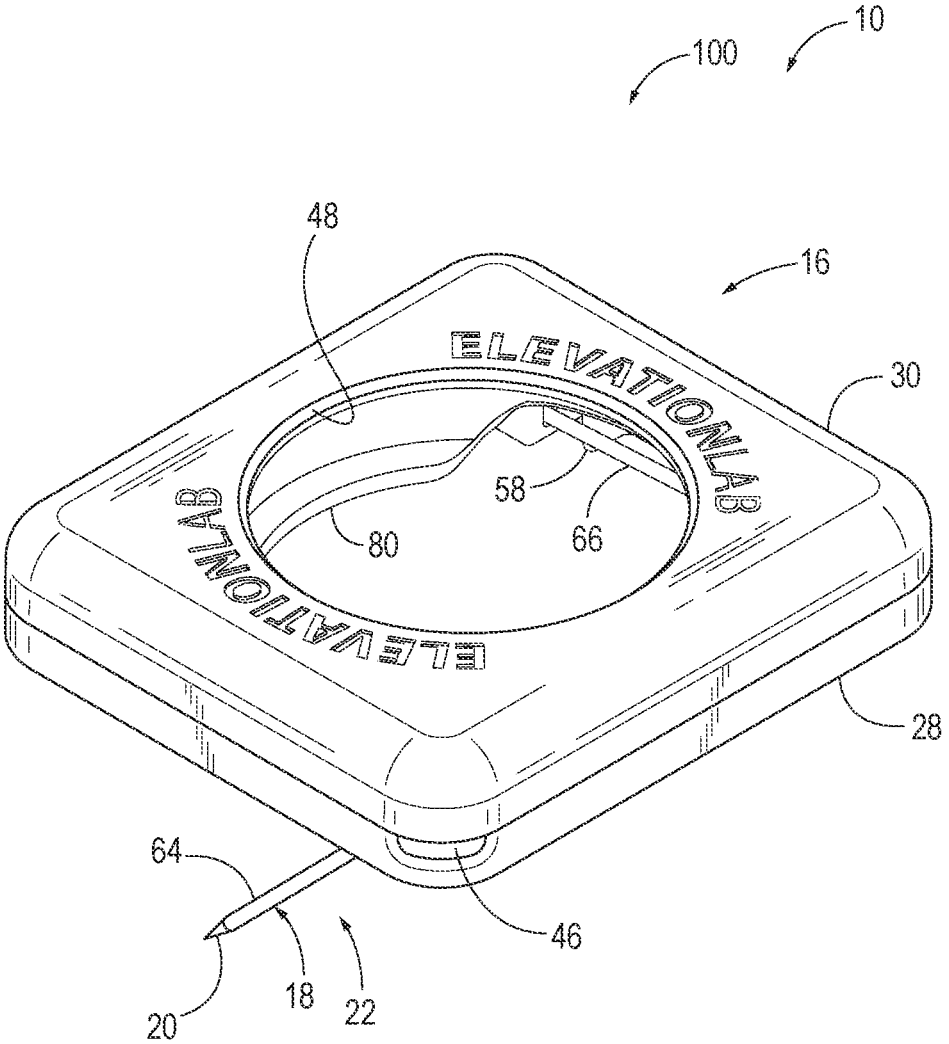
FIG. 3 is an exploded front isometric view of an example mount according to the present disclosure.
Figure 4:
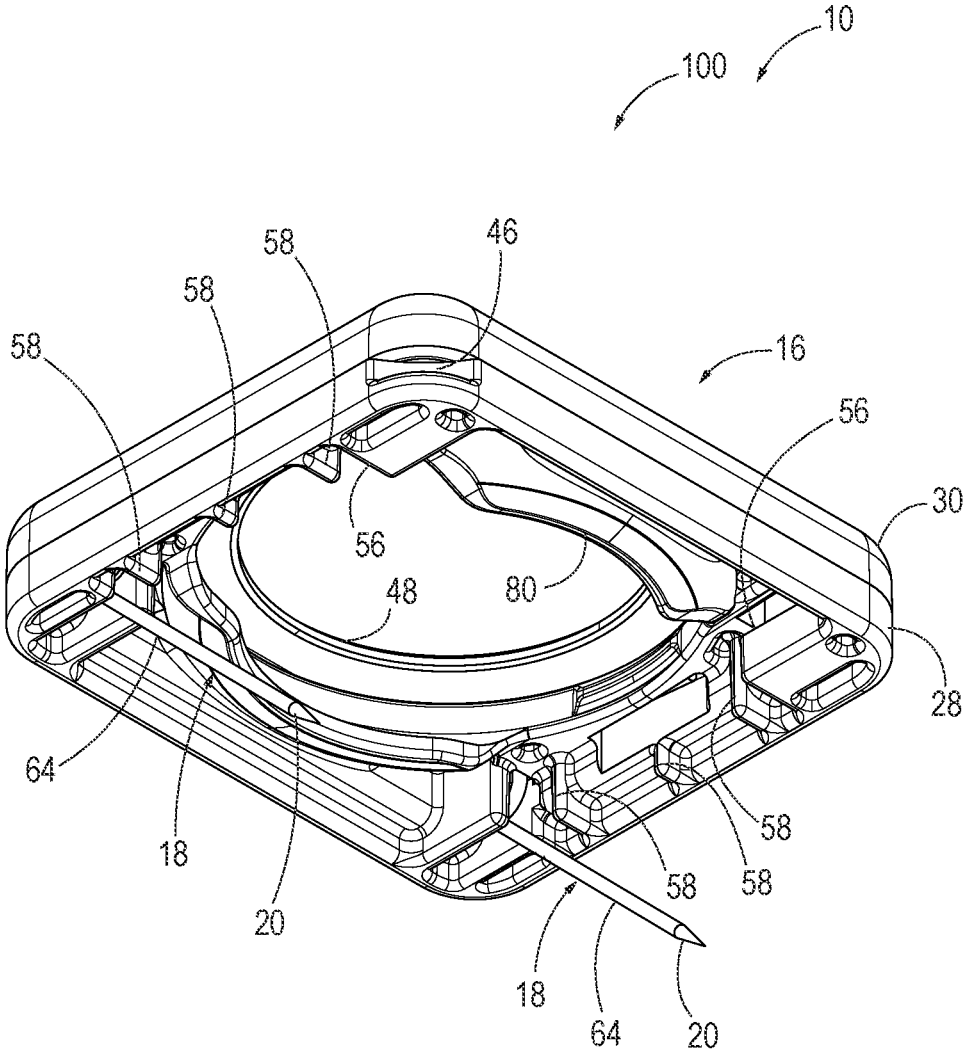
FIG. 4 is an isometric rear view of the mount of FIG. 3.
Figure 5:
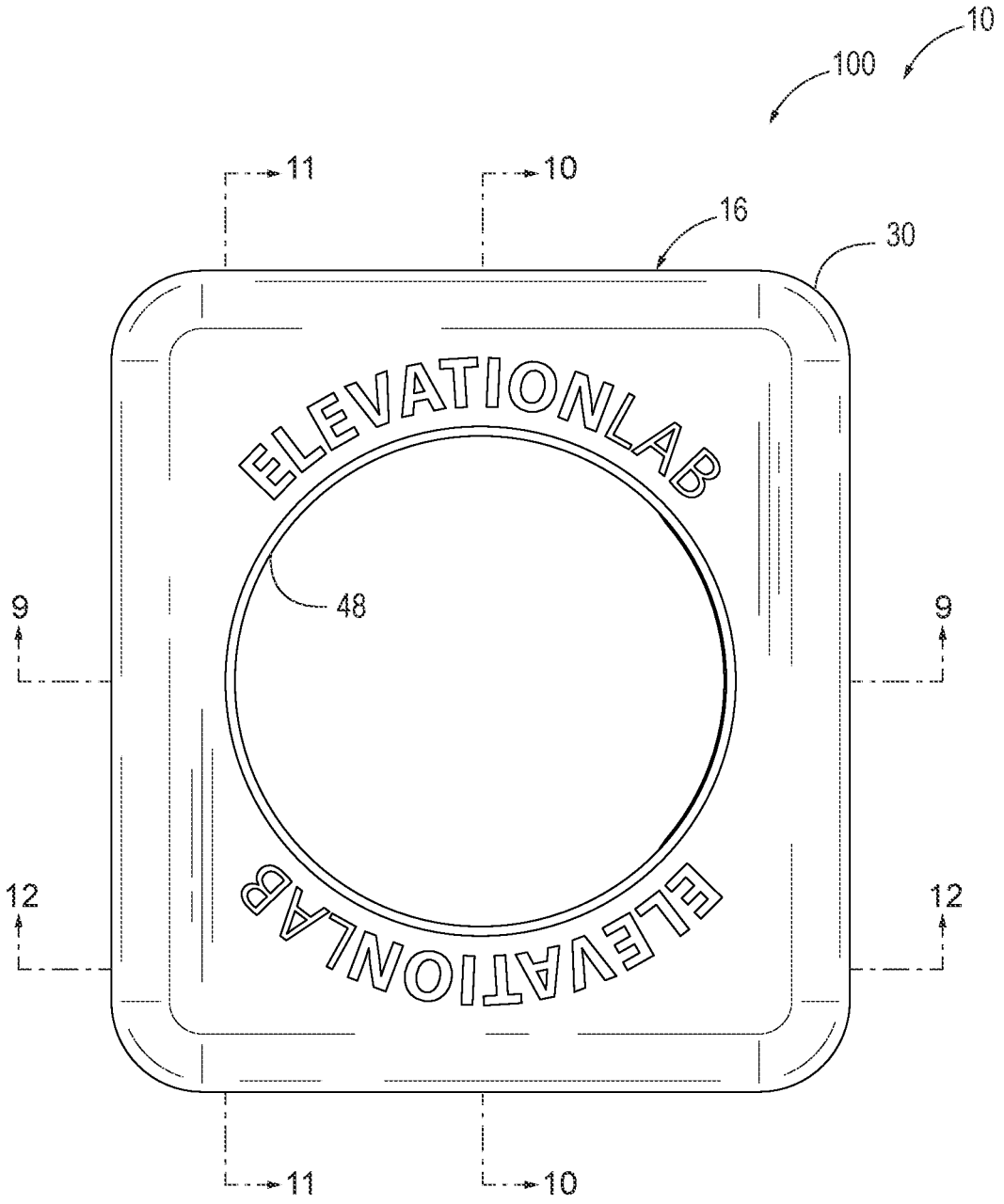
FIG. 5 is a front view of the mount of FIG. 3.
Figure 8:
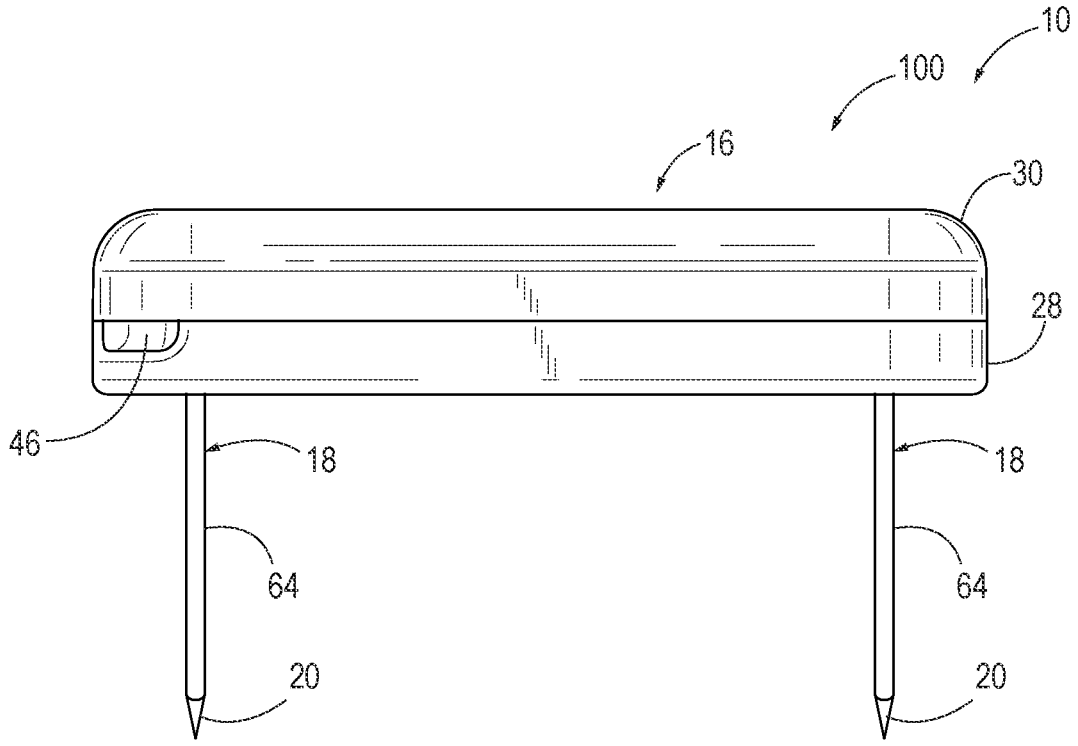
FIG. 8 is another side view of the mount of FIG. 3.
Figure 9:
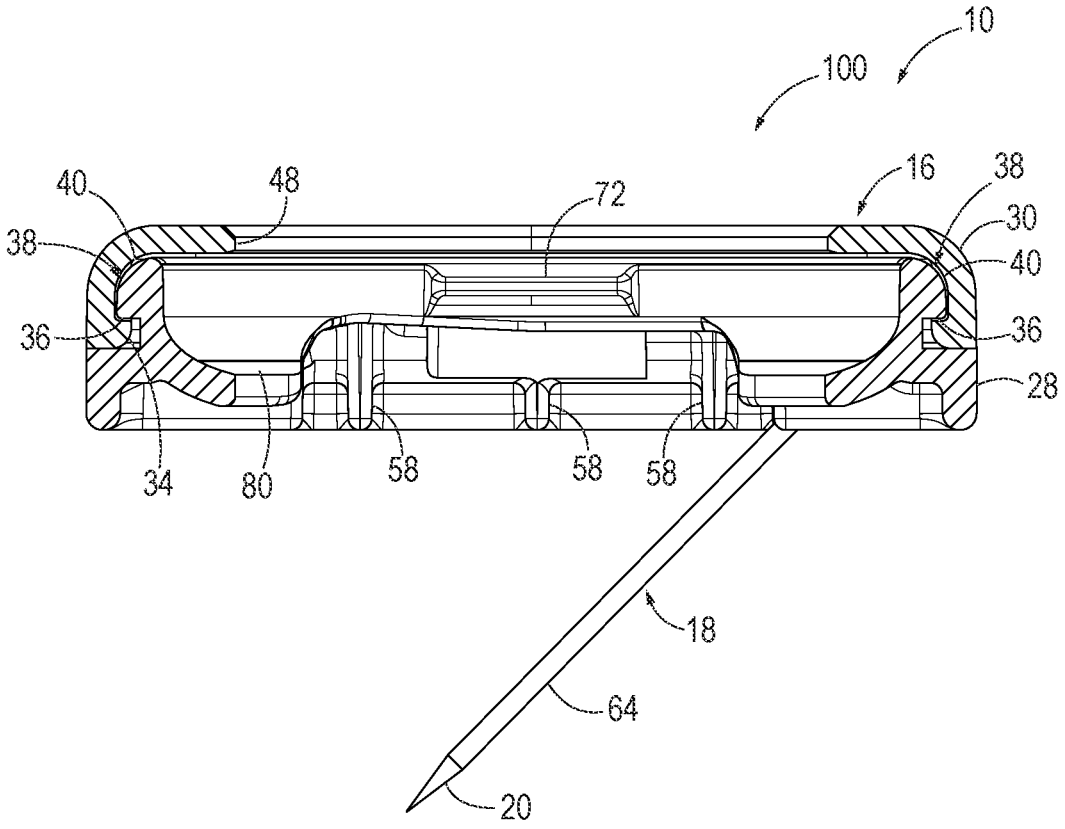
FIG. 9 is a cross-sectional view of the mount of FIG. 3, taken along line 9-9 of FIG. 5.

As best seen in FIGS. 3 and 8, the body 28 of mount 100 defines a recess 46 that permits a user to engage an underside of the cover 30 for removal from the body 28.

Mount 100 comprises two pins 18 spaced in close proximity to the perimeter of the housing 16, so as to create a stable attachment to an article 14.

Figure 10:
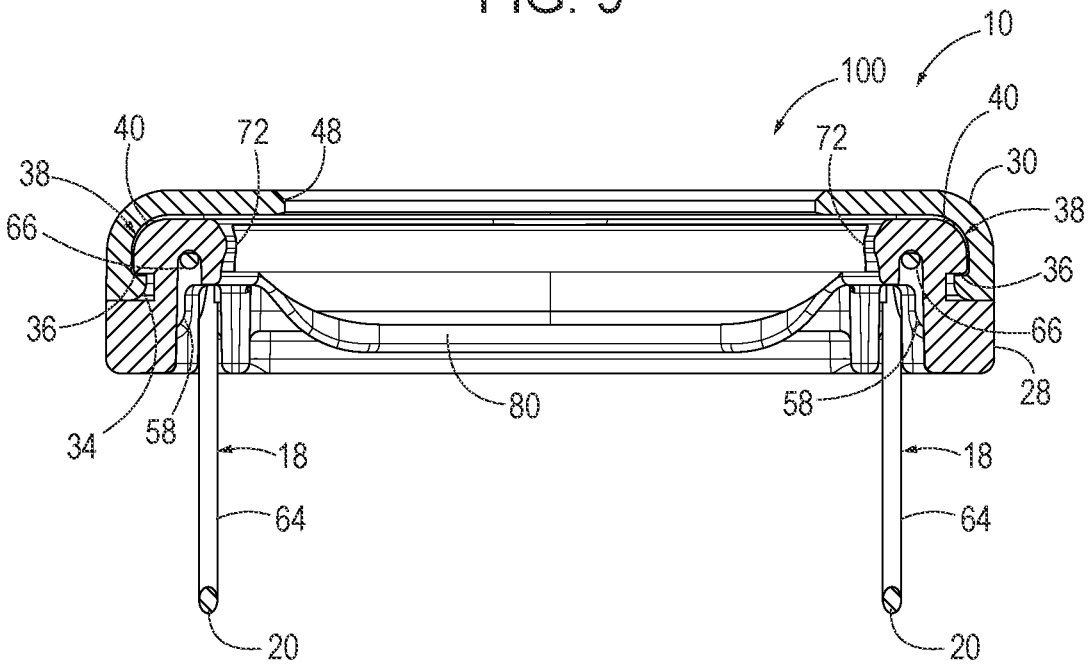
FIG. 10 is a cross-sectional view of the mount of FIG. 3, taken along line 10-10 of FIG. 5.
Figure 11:
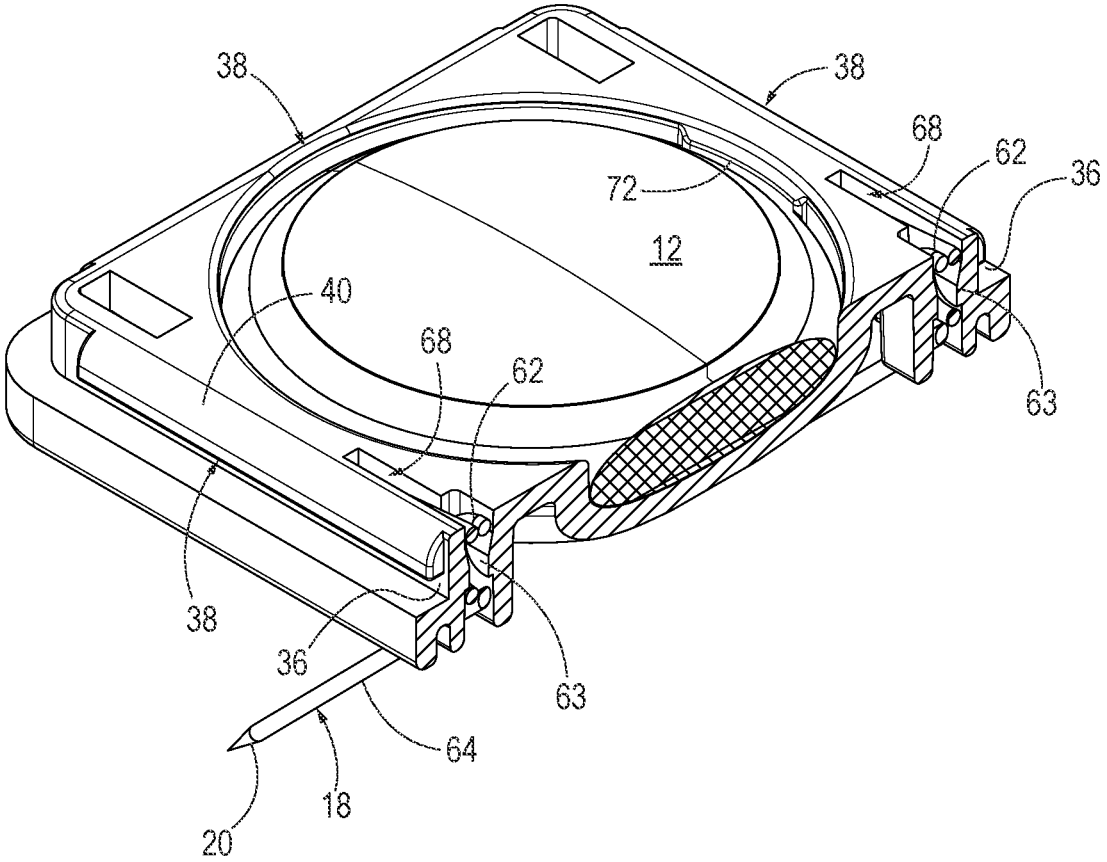
FIG. 11 is an isometric cross-sectional view of the mount of FIG. 3, taken along line 11-11 of FIG. 5, shown with the cover removed and with a tracking device present.
Figure 12:
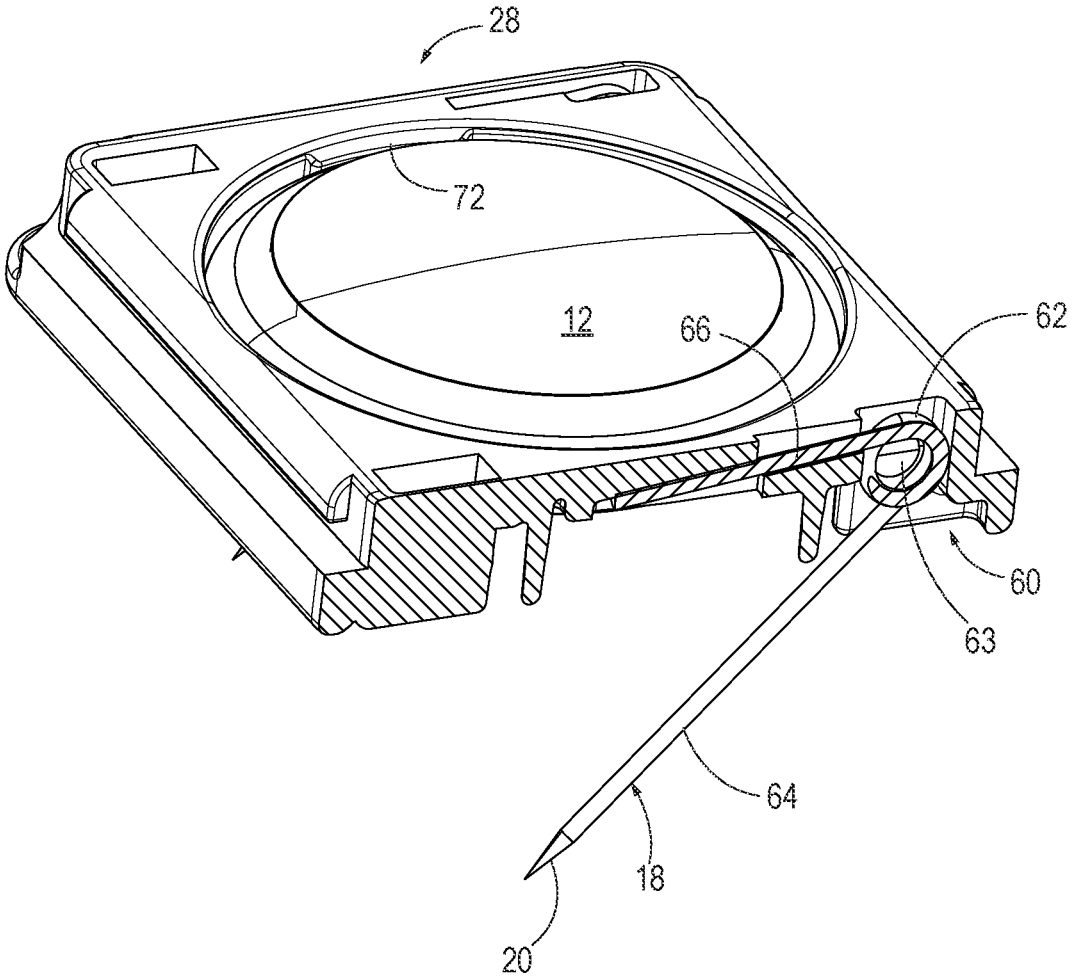
FIG. 12 is an isometric cross-sectional view of the mount of FIG. 3, taken along line 12-12 of FIG. 5, shown with the cover removed and with a tracking device present.

As best seen in FIGS. 10-12, the body 28 of mount 100 comprises a terminal lip 72 resulting in a snap-fit arrangement between the body 28 and a device 12. With reference to FIGS. 10-12, it can be seen that the terminal lip 72 does not extend fully around the body portion 70 of the volume 32, and thus the terminal lip 72 may be described as having two opposing portions.

Mount 100 is an example of a mount 10, whose cover 30 defines a window 48 and whose body 28 defines an opening 80, as discussed herein.

Moreover, mount 100 is an example of a mount 10, whose pins 18 comprise a grounded portion 66 extending into a respective grounding slot 68 and a torsion spring 62 that is positioned within a respective pin-installation cavity 60 that is open toward the first side 50 of the housing 16. Moreover, torsion-spring protrusions 63 extend into the pin-installation cavities 60, as seen in FIGS. 11 and 12.

Figure 6:
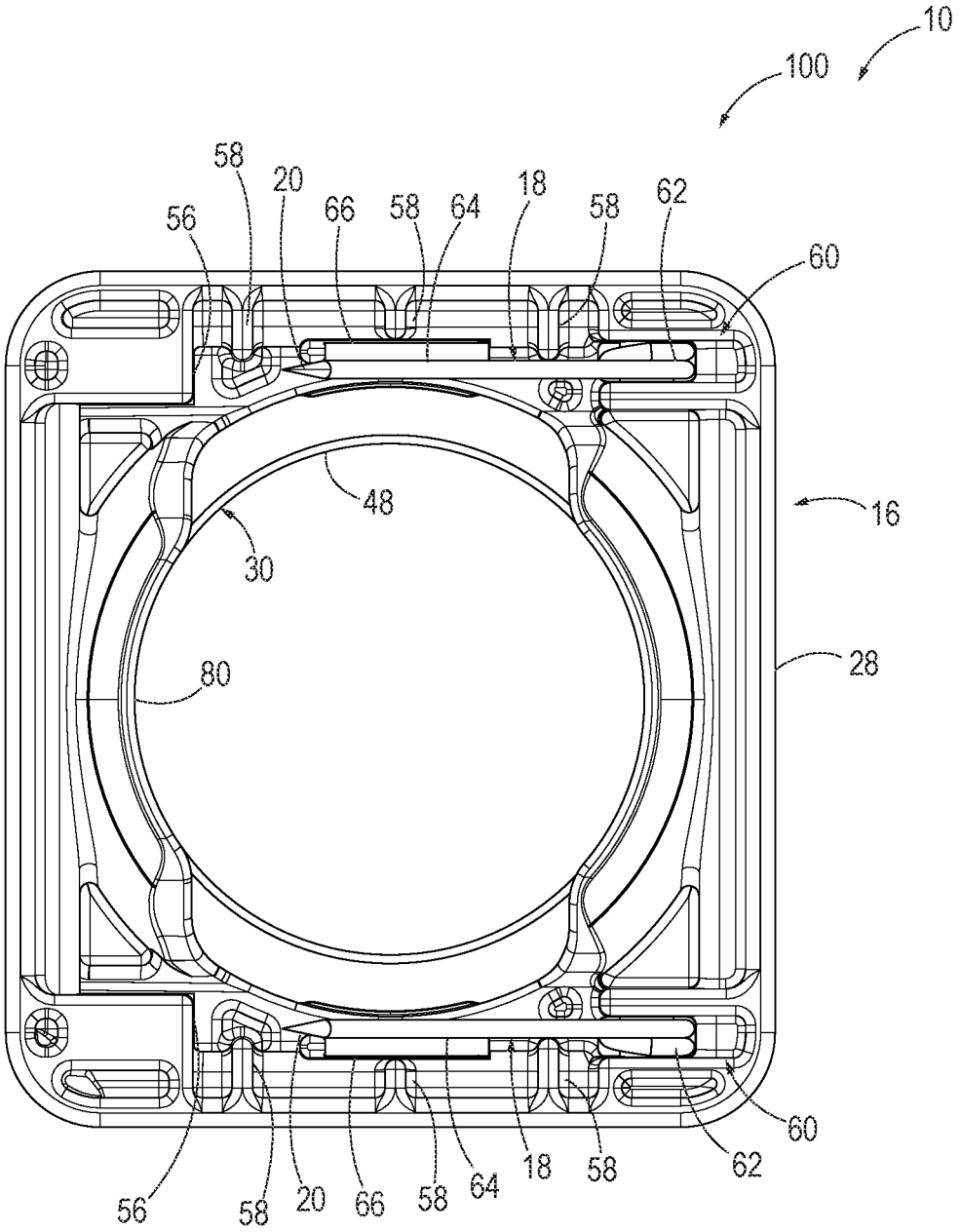
FIG. 6 is a rear view of the mount of FIG. 3.
Figure 7:
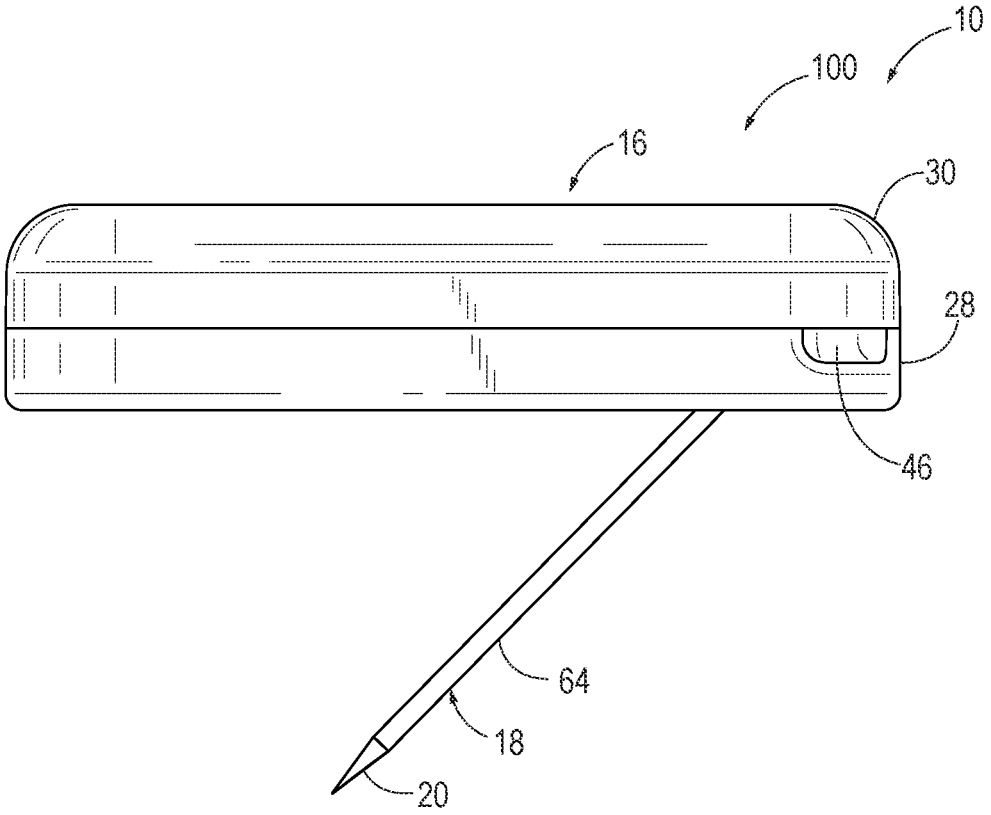
FIG. 7 is a side view of the mount of FIG. 3.
Figure 13:
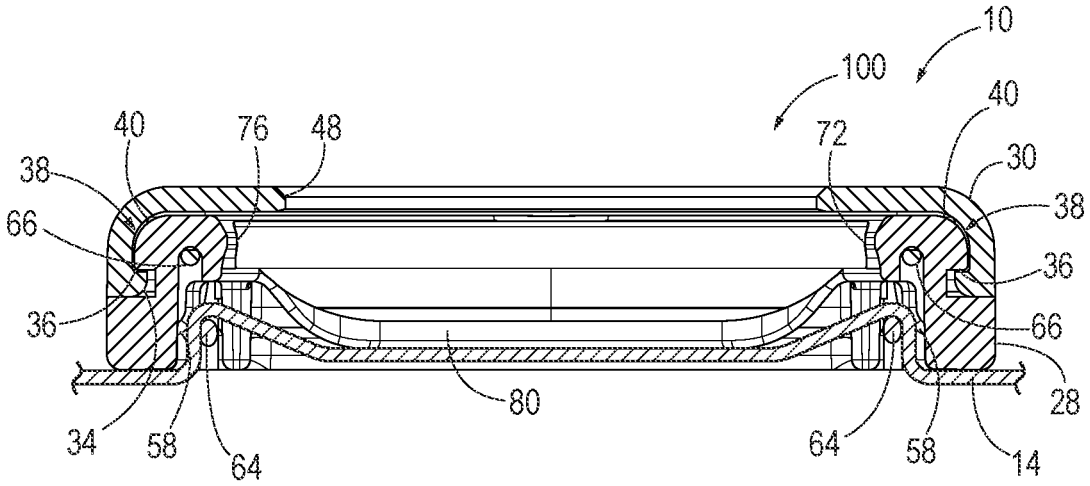
FIG. 13 is a cross-sectional view of the mount of FIG. 3, taken along line 10-10 of FIG. 5, shown attached to an article and with a tracking device present.

With reference to FIGS. 6 and 13, mount 100 is an example of a mount 10 whose housing 16 comprises a plurality of pin ribs 58 associated with and extending in close proximity to the piercing-end portion 64 of a respective pin 18 when in its closed position, to effectively pinch an article 14 between the pin ribs 58 and the pins 18, as seen in FIG. 13. In particular, each of the two pins 18 have three pin ribs 58 associated with the respective pin 18 and extending toward the outer side of the respective pin 18. The pin ribs 58 associated with each pin 18 are evenly spaced, with the outer two pin ribs 58 being spaced 0.1 mm from the respective pin 18 and with the middle pin rib 58 being spaced 1 mm from the respective pin 18.

Illustrative, non-exclusive examples of inventive subject matter according to the present disclosure are described in the following enumerated paragraphs:

A. A mount (10) for securing a device (12) to an article (14), the mount (10) comprising:

a housing (16) having a first side (50), a second side (52) opposite the first side (50), and a central axis (54) that extends through the first side (50) and the second side (52), wherein the housing (16) is configured to receive the device (12); and a pin (18) coupled to the housing (16), wherein the pin (18) comprises a piercing end (20), and wherein the pin (18) has:

an open position (22), in which the pin (18) extends away from the second side (52) of the housing (16), and in which the piercing end (20) is spaced away from the housing (16) and is positioned to pierce the article (14); and a closed position (24), in which the piercing end (20) is closer to the housing (16) than when in the open position (22).

A1. The mount (10) of paragraph A, wherein the housing (16) defines an envelope (26), and wherein the piercing end (20) is positioned within the envelope (26) when the pin (18) is in the closed position (24).

A1.1. The mount (10) of paragraph A1, wherein an entirety of the pin (18) is positioned within the envelope (26) when in the closed position (24).

A2. The mount (10) of any of paragraphs A-A1.1, wherein the housing (16) comprises a body (28) and a cover (30), and wherein the body (28) and the cover (30) collectively define a volume (32) configured to receive the device (12).

A2.1. The mount (10) of paragraph A2, wherein the cover (30) is removably coupled to the body (28).

A2.1.1. The mount (10) of paragraph A2.1, wherein the cover (30) has a snap-fit with the body (28).

A2.1.2. The mount (10) of any of paragraphs A2.1-A2.1.1, wherein the cover (30) is flexible and has a stretch-fit with the body (28).

A2.1.2.1. The mount (10) of paragraph A2.1.2, wherein the body (28) is more rigid than the cover (30).

A2.1.3. The mount (10) of any of paragraphs A2.1.1-A2.1.2.1, wherein the cover (30) comprises a lip (34) extending toward the central axis (54), and wherein the body (28) comprises a ledge (36) configured to mate with the lip (34) to operatively retain the cover (30) on the body (28).

A2.1.3.1. The mount (10) of paragraph A2.1.3, wherein the body (28) comprises one or more ledge ribs (38) that extend away from the central axis (54), wherein the one or more ledge ribs (38) comprise the ledge (36).

A2.1.3.1.1. The mount (10) of paragraph A2.1.3.1, wherein the one or more ledge ribs (38) comprise a ramped surface (40) opposite the ledge (36).

A2.1.3.1.2 The mount (10) of any of paragraphs A2.1.3.1-A2.1.3.1.1, wherein the one or more ledge ribs (38) comprise a plurality of ledge ribs (38) spaced around the body (28).

A2.2. The mount (10) of paragraph A2, wherein the cover (30) is hinged to the body (28).

A2.3. The mount (10) of any of paragraphs A2-A2.2, wherein the body (28) has a body perimeter (42), wherein the cover has a cover perimeter (44), wherein the body (28) defines a recess (46), and wherein the body perimeter (42) and the cover perimeter (44) are coextensive other than at the recess (46).

A2.4. The mount (10) of paragraph A2, wherein the cover (30) is threadingly coupled to body (28).

A2.5. The mount (10) of any of paragraphs A2-A2.4, wherein the cover (30) defines a window (48), through which the device (12) is visible when the device (12) is operatively received within the housing (16).

A.2.5.1. The mount (10) of paragraph A2.5, wherein the window (48) is sized to restrict passage of the device (12) through the window (48) when the device (12) is operatively received within the housing (16).

A3. The mount (10) of any of paragraphs A-A2.5.1, wherein the housing (16) comprises a catch (56) associated with the pin (18), and wherein the catch (56) is configured to selectively retain the pin (18) in the closed position (24).

A4. The mount (10) of any of paragraphs A-A3, wherein the housing (16) comprises a plurality of pin ribs (58) extending toward the pin (18) when the pin (18) is in the closed position (24).

A4.1. The mount (10) of paragraph A4, wherein each pin rib (58) of the plurality of pin ribs (58) extends in close proximity to the pin (18) when the pin (18) is in the closed position (24).

A4.2. The mount (10) of any of paragraphs A4-A4.1, wherein each pin rib (58) of the plurality of pin ribs (58) extends within 1 millimeter (mm) of the pin (18) when the pin (18) is in the closed position (24).

A4.3. The mount (10) of any of paragraphs A4-A4.2, wherein each pin rib (58) of the plurality of pin ribs (58) extends parallel to the central axis (54).

A5. The mount (10) of any of paragraphs A-A4.3, wherein the housing (16) comprises a/the body (28), wherein the body (28) defines a pin-installation cavity (60) open toward the first side (50) of the housing (16) and configured to receive the pin (18) via the first side (50) of the housing (16).

A6. The mount (10) of any of paragraphs A-A5, wherein the pin (18) comprises a torsion spring (62) that biases the pin (18) toward the open position (22).

A6.1. The mount (10) of paragraph A6 when depending from paragraph A5, wherein the torsion spring (62) is positioned within the pin-installation cavity (60).

A6.2. The mount (10) of any of paragraphs A6-A6.1, wherein the pin (18) further comprises a piercing-end portion (64) extending from the torsion spring (62) and a grounded portion (66) extending from the torsion spring (62), wherein the housing (16) defines a grounding slot (68), wherein the grounded portion (66) of the pin (18) extends into the grounding slot (68), and wherein the grounding slot (68) retains the pin (18) within the housing (16).

A6.2.1. The mount (10) of paragraph A6.2 when depending from paragraph A5, wherein the pin-installation cavity (60) is open to the grounding slot (68).

A7. The mount (10) of any of paragraphs A-A6.2.1, comprising a plurality of pins (18) coupled to the housing (16).

A7.1. The mount (10) of paragraph A7, wherein the plurality of pins (18) consists of two pins (18).

A7.2. The mount (10) of any of paragraphs A7-A7.1, wherein the housing (16) comprises a/the body (28), wherein the body (28) has a body width (78) and a/the body perimeter (42), and wherein each pin (18) of the plurality of pins (18) is positioned within 15% of the body width (78) from the body perimeter (42).

A8. The mount (10) of any of paragraphs A-A7, wherein the housing (16) is configured to receive the device (12) in a snap-fit arrangement or a friction-fit arrangement.

A9. The mount (10) of any of paragraphs A-A8, wherein the housing (16) comprises a/the body (28), wherein the housing (16) defines a/the volume (32) configured to receive the device (12), wherein the volume (32) comprises a body portion (70) defined by the body (28), wherein the body (28) comprises a terminal lip (72), wherein the body portion (70) of the volume (32) has a maximum body-portion dimension (74) defined by the body (28), and wherein the terminal lip (72) defines an inside-lip dimension (76) that is less than the maximum body-portion dimension (74).

A10. The mount (10) of any of paragraphs A-A9, wherein the housing (16) defines an opening (80), wherein the opening (80) is sized to restrict passage of the device (12) through the opening (80) and is sized to permit a user's finger to extend through the opening (80) to engage the device (12) and urge the device (12) along the central axis (54) and out of the housing (16).

A10.1. The mount (10) of paragraph A10 when depending from paragraph A2, wherein the body (28) defines the opening (80).

A10.2. The mount (10) of any of paragraphs A10-A10.1 when depending from paragraph A8, wherein the opening (80) is sized to permit a/the user's finger to extend through the opening (80) to engage the device (12) and urge the device (12) along the central axis (54), out of the snap-fit arrangement or friction-fit arrangement, and out of the housing (16).

All. The mount (10) of any of paragraphs A-A10.2, further comprising the device (12) received within the housing (16).

A11.1. The mount (10) of paragraph A11, wherein the device (12) is a tracking device.

A11.1.1. The mount (10) of paragraph A11.1, wherein the tracking device is an Apple AirTag™ tracking device.

B. A mount (10) for securing a device (12) to an article (14), the mount (10) comprising:

means for holding the device (12); and means for attaching the means for holding the device (12) to the article (14).

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A mount (10) for securing a device (12) to an article (14), the mount (10) comprising:

a housing (16) having a first side (50), a second side (52) opposite the first side (50), and a central axis (54) that extends through the first side (50) and the second side (52), wherein the housing (16) is configured to receive the device (12); and a pin (18) coupled to the housing (16), wherein the pin (18) comprises a piercing end (20), and wherein the pin (18) has:

an open position (22), in which the pin (18) extends away from the second side (52) of the housing (16), and in which the piercing end (20) is spaced away from the housing (16) and is positioned to pierce the article (14); and a closed position (24), in which the piercing end (20) is closer to the housing (16) than when in the open position (22);

wherein the housing (16) comprises a body (28) and a cover (30), and wherein the body (28) and the cover (30) collectively define a volume (32) configured to receive the device (12), and wherein the cover (30) is removably coupled to the body (28).

2. The mount (10) of claim 1, wherein the housing (16) defines an envelope (26), and wherein an entirety of the pin (18) is positioned within the envelope (26) when in the closed position (24).

3. The mount (10) of claim 1, wherein the cover (30) is flexible and has a stretch-fit with the body (28).

4. The mount (10) of claim 1, wherein the cover (30) comprises a lip (34) extending toward the central axis (54), and wherein the body (28) comprises a ledge (36) configured to mate with the lip (34) to operatively retain the cover (30) on the body (28).

5. The mount (10) of claim 4, wherein the body (28) comprises a plurality of ledge ribs (38) spaced around the body (28) which extend away from the central axis (54), wherein the plurality of ledge ribs (38) define the ledge (36), and wherein each ledge rib (38) of the plurality of ledge ribs (38) comprises a ramped surface (40) opposite the ledge (36).

6. The mount (10) of claim 1, wherein the body (28) has a body perimeter (42), wherein the cover has a cover perimeter (44), wherein the body (28) defines a recess (46), and wherein the body perimeter (42) and the cover perimeter (44) are coextensive other than at the recess (46).

7. The mount (10) of claim 1, wherein the cover (30) defines a window (48), through which the device (12) is visible when the device (12) is operatively received within the housing (16), and wherein the window (48) is sized to restrict passage of the device (12) through the window (48) when the device (12) is operatively received within the housing (16).

8. The mount (10) of claim 1, wherein the housing (16) comprises a plurality of pin ribs (58) extending toward the pin (18) when the pin (18) is in the closed position (24), and wherein each pin rib (58) of the plurality of pin ribs (58) extends within 1 millimeter (mm) of the pin (18) when the pin (18) is in the closed position (24).

9. The mount (10) of claim 1, wherein the body (28) defines a pin-installation cavity (60) open toward the first side (50) of the housing (16) and configured to receive the pin (18) via the first side (50) of the housing (16).

10. A mount (10) for securing a device (12) to an article (14), the mount (10) comprising:

a housing (16) having a first side (50), a second side (52) opposite the first side (50), and a central axis (54) that extends through the first side (50) and the second side (52), wherein the housing (16) is configured to receive the device (12); and a pin (18) coupled to the housing (16), wherein the pin (18) comprises a piercing end (20), and wherein the pin (18) has:

an open position (22), in which the pin (18) extends away from the second side (52) of the housing (16), and in which the piercing end (20) is spaced away from the housing (16) and is positioned to pierce the article (14); and a closed position (24), in which the piercing end (20) is closer to the housing (16) than when in the open position (22);

wherein the housing (16) comprises a body (28), wherein the body (28) defines a pin-installation cavity (60) open toward the first side (50) of the housing (16) and configured to receive the pin (18) via the first side (50) of the housing (16); and wherein the pin (18) comprises a torsion spring (62) that biases the pin (18) toward the open position (22), and wherein the torsion spring (62) is positioned within the pin-installation cavity (60).

11. The mount (10) of claim 10, wherein the pin (18) further comprises a piercing-end portion (64) extending from the torsion spring (62) and a grounded portion (66) extending from the torsion spring (62), wherein the housing (16) defines a grounding slot (68), wherein the grounded portion (66) of the pin (18) extends into the grounding slot (68), wherein the grounding slot (68) retains the pin (18) within the housing (16), and wherein the pin-installation cavity (60) is open to the grounding slot (68).

12. The mount (10) of claim 1, comprising a plurality of pins (18) coupled to the housing (16).

13. The mount (10) of claim 12, wherein the plurality of pins (18) consists of two pins (18).

14. The mount (10) of claim 12, wherein the body (28) has a body width (78) and a body perimeter (42), and wherein each pin (18) of the plurality of pins (18) is positioned within 15% of the body width (78) from the body perimeter (42).

15. The mount (10) of claim 1, wherein the housing (16) is configured to receive the device (12) in a snap-fit arrangement or a friction-fit arrangement.

16. The mount (10) of claim 1, wherein the housing (16) defines a volume (32) configured to receive the device (12), wherein the volume (32) comprises a body portion (70) defined by the body (28), wherein the body (28) comprises a terminal lip (72), wherein the body portion (70) of the volume (32) has a maximum body-portion dimension (74) defined by the body (28), and wherein the terminal lip (72) defines an inside-lip dimension (76) that is less than the maximum body-portion dimension (74).

17. The mount (10) of claim 1, wherein the housing (16) defines an opening (80), wherein the opening (80) is sized to restrict passage of the device (12) through the opening (80) and is sized to permit a user's finger to extend through the opening (80) to engage the device (12) and urge the device (12) along the central axis (54) and out of the housing (16).

18. The mount (10) of claim 1, further comprising the device (12) received within the housing (16).

19. A mount (10) for securing a device (12) to an article (14), the mount (10) comprising:

a housing (16) having a first side (50), a second side (52) opposite the first side (50), and a central axis (54) that extends through the first side (50) and the second side (52), wherein the housing (16) is configured to receive the device (12); and a pin (18) coupled to the housing (16), wherein the pin (18) comprises a piercing end (20), and wherein the pin (18) has:

an open position (22), in which the pin (18) extends away from the second side (52) of the housing (16), and in which the piercing end (20) is spaced away from the housing (16) and is positioned to pierce the article (14); and a closed position (24), in which the piercing end (20) is closer to the housing (16) than when in the open position (22);

wherein the housing (16) defines an envelope (26), and wherein an entirety of the pin (18) is positioned within the envelope (26) when in the closed position (24).

20. The mount (10) of claim 19, wherein the housing (16) comprises a plurality of pin ribs (58) extending toward the pin (18) when the pin (18) is in the closed position (24), and wherein each pin rib (58) of the plurality of pin ribs (58) extends within 1 millimeter (mm) of the pin (18) when the pin (18) is in the closed position (24).

* * * * *